US011311168B2

(12) United States Patent
Rosenbauer

(10) Patent No.: US 11,311,168 B2
(45) Date of Patent: Apr. 26, 2022

(54) DISHWASHER AND METHOD FOR OPERATING A DISHWASHER

(71) Applicant: BSH Hausgeräte GmbH, Munich (DE)

(72) Inventor: Michael Georg Rosenbauer, Reimlingen (DE)

(73) Assignee: BSH Hausgeräte GmbH, Munich (DE)

( * ) Notice: Subject to any disclaimer, the term of this patent is extended or adjusted under 35 U.S.C. 154(b) by 106 days.

(21) Appl. No.: 16/606,776

(22) PCT Filed: May 7, 2018

(86) PCT No.: PCT/EP2018/061650
§ 371 (c)(1),
(2) Date: Oct. 21, 2019

(87) PCT Pub. No.: WO2018/210595
PCT Pub. Date: Nov. 22, 2018

(65) Prior Publication Data

US 2020/0187745 A1 Jun. 18, 2020

(30) Foreign Application Priority Data

May 19, 2017 (DE) ..... 10 2017 208 562.2

(51) Int. Cl.
*A47L 15/00* (2006.01)
*A47L 15/42* (2006.01)
*A47L 15/46* (2006.01)

(52) U.S. Cl.
CPC ..... *A47L 15/0028* (2013.01); *A47L 15/0007* (2013.01); *A47L 15/4221* (2013.01);
(Continued)

(58) Field of Classification Search
CPC ..... A47L 15/0005; A47L 15/0007; A47L 15/0026; A47L 15/0028; A47L 15/4221;
(Continued)

(56) References Cited

U.S. PATENT DOCUMENTS 5,924,432 A * 7/1999 Thies ..... A47L 15/23 134/56 D
9,320,410 B2 * 4/2016 Delle ..... A47L 15/0015
(Continued)

FOREIGN PATENT DOCUMENTS

| | | |
|---|---|---|
| DE | 102016102334 A1 | 8/2016 |
| EP | 2425758 A1 | 3/2012 |
| GB | 1522153 | 8/1978 |

OTHER PUBLICATIONS

International Search Report PCT/EP2018/061650 dated Jul. 11, 2018.

*Primary Examiner* — Spencer E. Bell
(74) *Attorney, Agent, or Firm* — Michael E. Tschupp; Andre Pallapies; Brandon G. Braun

(57) ABSTRACT

A dishwasher includes a dishwashing container, a lower holder for items to be washed arranged in the dishwashing container, and an upper holder for items to be washed which is arranged in the dishwasher container above the lower holder. A control device executes a dishwashing program from a number of dishwashing programs for washing the items to be washed by actuating a hydraulic facility in such a manner that in a first segment of the dishwashing program a washing liquor having a first washing liquor temperature is only sprayed by a lower spray facility onto the lower holder and in a second segment of the dishwashing program following the first segment washing liquor having a second washing liquor temperature that is lower than the first washing liquor temperature is sprayed by an upper spray facility onto the lower holder and the upper holder.

9 Claims, 4 Drawing Sheets

(52) U.S. Cl.
CPC ..... *A47L 15/46* (2013.01); *A47L 2301/04* (2013.01); *A47L 2501/01* (2013.01); *A47L 2501/03* (2013.01); *A47L 2501/05* (2013.01); *A47L 2501/06* (2013.01); *A47L 2501/20* (2013.01)

(58) Field of Classification Search
CPC .. A47L 15/46; A47L 2301/04; A47L 2501/03; A47L 2501/20
See application file for complete search history.

(56) References Cited

U.S. PATENT DOCUMENTS

| | | | | |
|---|---|---|---|---|
| 2010/0043828 | A1 | 2/2010 | Choi et al. | |
| 2012/0042908 | A1* | 2/2012 | Jerg ..... | A47L 15/0018 134/18 |

* cited by examiner

DISHWASHER AND METHOD FOR OPERATING A DISHWASHER

CROSS-REFERENCES TO RELATED APPLICATIONS

This application is the U.S. National Stage of International Application No. PCT/EP2018/061650, filed May 7, 2018, which designated the United States and has been published as International Publication No. WO 2018/210595 A1 and which claims the priority of German Patent Application, Serial No. 10 2017 208 562.2, filed May 19, 2017, pursuant to 35 U.S.C. 119(a)-(d).

BACKGROUND OF THE INVENTION

The present invention relates to a dishwasher, in particular a household dishwasher, as well as a method for operating such a dishwasher.

Conventional dishwashers have what are known as automatic programs, which automatically select a washing liquor temperature based on identification of the degree of soiling of the items to be washed during the performance of the dishwashing program for washing the items to be washed. This can be in the region of 60° C.-80° C. for heavy soiling in particular. A good cleaning performance can be achieved at these temperatures but such a high temperature has a negative effect on glass corrosion. Glass corrosion causes premature ageing, in particular of glasses washed in the dishwasher. This is undesirable and very annoying, in particular when the glasses are good quality and expensive. There is therefore a need for a dishwashing program that is gentle on glass but which also maintains cleaning performance in particular.

Conventional dishwashers and methods for operating dishwashers are known from DE 24 41 361 A1, WO 2012/028710 A1 and EP 2 425 758.

BRIEF SUMMARY OF THE INVENTION

Against this background one object of the present invention is to propose an improved dishwasher.

According to a first aspect a dishwasher, in particular a household dishwasher, is proposed, with a dishwashing container, a lower holder for items to be washed arranged in the dishwashing container, an upper holder for items to be washed arranged above the lower holder for items to be washed, a lower spray facility assigned to the lower holder for items to be washed for spraying the items to be washed arranged in the lower holder for items to be washed with washing liquor, an upper spray facility assigned to the upper holder for items to be washed for spraying the items to be washed arranged in the upper holder for items to be washed with the washing liquor, a hydraulic facility for conveying the washing liquor to the lower spray facility and to the upper spray facility, and a control device for performing a dishwashing program from a number of dishwashing programs for washing the items to be washed, the control device being designed to actuate the hydraulic facility in such a manner that in a first segment of the dishwashing program the washing liquor having a first washing liquor temperature is only sprayed onto the lower holder for items to be washed and in a second segment of the dishwashing program following the first segment the washing liquor having a second washing liquor temperature that is lower than the first washing liquor temperature is sprayed onto the lower holder for items to be washed and the upper holder for items to be washed.

Because only the items to be washed in the lower holder for items to be washed are sprayed with the washing liquor having the higher first washing liquor temperature in the first segment of the dishwashing program, the items to be washed in the upper holder for items to be washed are not exposed to the washing liquor having the higher first washing liquor temperature. In contrast, items to be washed in the lower holder for items to be washed, for example pans, can advantageously be cleaned with the washing liquor with the higher first washing liquor temperature.

If glasses for example are arranged in the upper holder for items to be washed, said glasses are not sprayed with the washing liquor with the higher first washing liquor temperature, thereby reducing glass corrosion and/or wear of the glasses. The glasses in the upper holder for items to be washed can then be cleaned using the washing liquor having the lower second washing liquor temperature in the second segment of the dishwashing program.

The second washing liquor temperature is particularly below 60°, preferably below 55° C., more preferably below 50° C. The first washing liquor temperature is particularly above 65°, preferably above 70° C., particularly preferably above 75° C.

The control device can be implemented as hardware and/or software. In the case of a hardware implementation the control device can be configured as a verification device or as part of a backend, for example as a computer or microprocessor. In the case of a software implementation the control device can be configured as a computer program product, function, routine, part of a program code or an executable object.

The washing liquor or washing liquid is water, to which chemicals such as detergent or rinse aid can be added, which is circulated by the circulating pump in a circuit for washing the items to be washed and can contain dirt particles.

The spray facility comprises at least one device for spraying the items to be washed with the washing liquid. The respective device can be for example a rotating spray arm or a nozzle installed in a fixed position in the dishwashing container.

According to one embodiment of the dishwasher the washing liquor is provided with the first washing liquor temperature and a first quantity of washing liquor in the dishwashing container in the first segment. The washing liquor is then provided with the second washing liquor temperature and a second quantity of washing liquor, which is greater than the first quantity of washing liquor, in the dishwashing container in the second segment.

According to a further embodiment the dishwasher comprises a fresh water connection for conducting fresh water into the dishwashing container and a valve arranged between the fresh water connection and the dishwashing container. The control device here is designed to actuate the valve after the first segment to increase the quantity of washing liquor in the dishwashing container from the first quantity of washing liquor to the second quantity of washing liquor and to reduce the washing liquor temperature in the dishwashing container from the first washing liquor temperature to the second washing liquor temperature. Alternatively the first segment of the dishwashing program can be lengthened such that the temperature of the washing liquor cools to the second washing liquor temperature without additional measures.

According to a further embodiment of the dishwasher the hydraulic facility comprises a pump and/or a water diverter.

The pump is for example a circulating pump for circulating the washing liquor in the dishwasher. The circulating pump is preferably arranged in a sump of the dishwasher. The sump is a receiver for liquid arranged below the dishwashing container ahead of a pump, for example the circulating pump or a drain pump. The water diverter is a device with an inlet and a number of outlets, which is designed to distribute liquid entering by way of the inlet by way of the number of outlets. The water diverter is arranged in particular between the circulating pump and the spray facilities. An intake of the water diverter for example is connected to an outlet of the circulating pump, a first outlet of the water diverter is connected to an intake of the lower spray facility and a second outlet of the water diverter is connected to an intake of the storage facility.

According to a further embodiment of the dishwasher the pump is configured as a circulating pump for supplying the lower spray facility and the upper spray facility with the washing liquor.

According to a further embodiment of the dishwasher the control device is designed to set a speed of the circulating pump and/or a position of the water diverter in the first segment of the dishwashing program such that only the lower spray facility is supplied with washing liquor.

Such control of circulating pump and/or water diverter ensures that washing liquor is only sprayed onto items to be washed in the lower holder for items to be washed in the first segment.

According to a further embodiment of the dishwasher the upper spray facility is configured as an upper spray arm and the lower spray facility is configured as a lower spray arm.

According to a further embodiment of the dishwasher the lower spray arm is arranged below the lower holder for items to be washed. The lower spray arm preferably has outlet openings pointing upward in the direction of the lower holder for items to be washed for spraying jets of washing liquor.

According to a further embodiment of the dishwasher the control device is designed to set a speed of the circulating pump in the first segment of the dishwashing program such that only the lower spray arm is supplied with washing liquor and the jets sprayed out of the outlet openings of the lower spray arm only come into contact with items to be washed that are held in the lower holder for items to be washed.

According to a further embodiment of the dishwasher the dishwashing program is a cleaning dishwashing program, in which a cleaning agent is added to the washing liquor, the first segment corresponding to a first step of the cleaning dishwashing program.

Alternatively or additionally the dishwashing program comprises a cleaning program sub-step, in which a cleaning agent is added to the washing liquor, the first segment corresponding to a first step of the cleaning program sub-step.

According to a further embodiment of the dishwasher the dishwashing program is a pre-rinse, the first segment corresponding to a first step of the pre-rinse.

According to a further embodiment of the dishwasher the dishwashing program is a high-temperature dishwashing program, the first segment corresponding to a first step of the high-temperature dishwashing program and the washing liquor temperature being at least 65° C. in the first segment.

According to a second aspect a method for operating a dishwasher, in particular a household dishwasher, is proposed. The dishwasher comprises a dishwashing container, a lower holder for items to be washed arranged in the dishwashing container, an upper holder for items to be washed arranged above the lower holder for items to be washed, a lower spray facility assigned to the lower holder for items to be washed for spraying the items to be washed arranged in the lower holder for items to be washed with washing liquor, an upper spray facility assigned to the upper holder for items to be washed for spraying the items to be washed arranged in the upper holder for items to be washed with the washing liquor, a hydraulic facility for conveying the washing liquor to the lower spray facility and to the upper spray facility, and a control device for performing a dishwashing program from a number of dishwashing programs for washing the items to be washed.

The hydraulic facility here is actuated by the control device in such a manner that in a first segment of the dishwashing program the washing liquor having a first washing liquor temperature is only sprayed onto the lower holder for items to be washed and in a second segment of the dishwashing program following the first segment the washing liquor having a second washing liquor temperature that is lower than the first washing liquor temperature is sprayed onto the lower holder for items to be washed and the upper holder for items to be washed.

The embodiments and features described for the proposed dishwasher apply to the proposed method accordingly.

BRIEF DESCRIPTION OF THE DRAWINGS

Further advantageous configurations of the dishwasher are set out in the subclaims and the exemplary embodiments of the dishwasher described in the following. The dishwasher is also described in more detail based on preferred embodiments with reference to the accompanying figures.

DETAILED DESCRIPTION OF EXEMPLARY EMBODIMENTS OF THE PRESENT INVENTION

Figure 1:
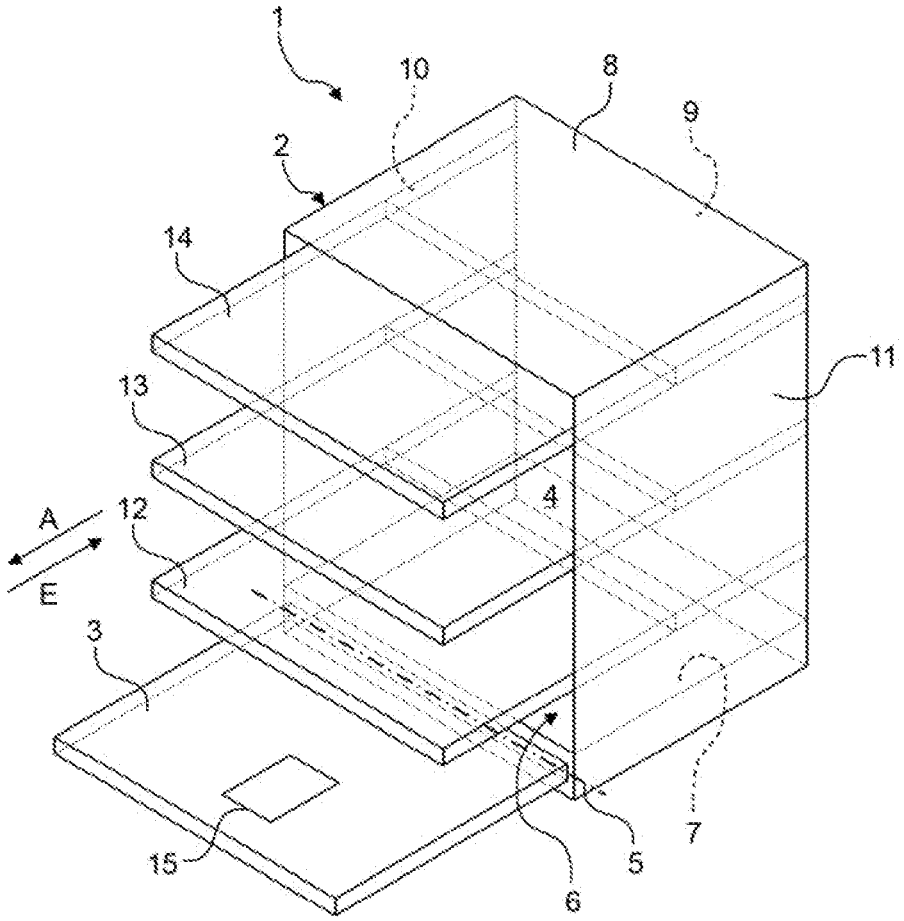
FIG. 1 shows a schematic perspective view of an exemplary embodiment of a dishwasher.

Identical elements or those of identical function are shown with the same reference characters in the figures, unless otherwise specified.

FIG. 1 shows a schematic perspective view of an embodiment of a dishwasher 1. The dishwasher 1 can be a free-standing, integrated or fully integrated dishwasher 1 for example. The dishwasher 1 here is configured as a household dishwasher 1. The household dishwasher 1 comprises a dishwashing container 2, which can be closed by a door 3, in particular in a water-tight manner. To this end a sealing facility (not shown) can be provided between the door 3 and the dishwashing container 2. The dishwashing container 2 is preferably box-shaped. The dishwashing container 2 can be arranged in a housing of the household dishwasher 1. The dishwashing container 2 and door 3 can form a dishwashing chamber 4 for washing items to be washed.

The door 3 is shown in its opened position in FIG. 1. The door 3 can be closed or opened by a pivoting movement about a pivot axis 5 provided at a lower end of the door 3. The door 3 can be used to close or open a loading opening 6 of the dishwashing container 2. The dishwashing container 2 has a base 7, a top 8 arranged opposite the base 7, a rear wall 9 arranged opposite the closed door 3 and two side walls 10, 11 arranged opposite one another. The base 7, top 8, rear wall 9 and side walls 10, 11 can be made of stainless steel sheet for example. Alternatively the base 7 for example can be made of a plastic material.

The household dishwasher 1 also has at least one holder 12, 13, 14 for items to be washed. Several, for example three, holders 12, 13, 14 for items to be washed can preferably be provided, it being possible for the holder 12 for items to be washed to be a lower holder for items to be washed or lower rack, the holder 13 for items to be washed to be an upper holder for items to be washed or upper rack and the holder 14 for items to be washed to be a flatware drawer. As also shown in FIG. 1, the holders 12, 13, 14 for items to be washed are arranged one above the other in the dishwashing container 2. Each holder 12 to 14 for items to be washed can be moved into or out of the dishwashing container 2 as required. In particular each holder 12, 13, 14 for items to be washed can be pushed into the dishwashing container 2 in an insertion direction E and pulled out of the dishwashing container 2 in a removal direction A counter to the insertion direction E.

The household dishwasher 1 also comprises a control device 15, which is designed to control different components and units of the household dishwasher 1. In the exemplary embodiment in FIG. 1 the control device 15 is provided by way of example on the door 3 of the household dishwasher 1.

Figure 2:
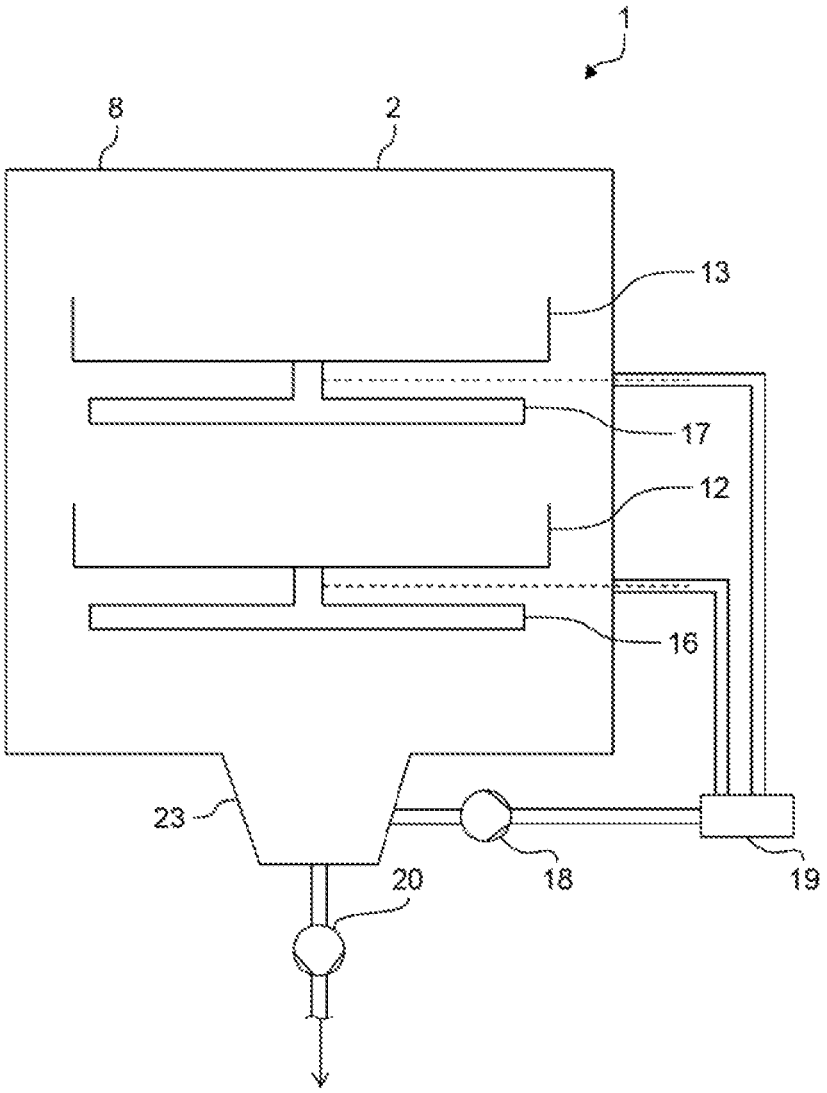
FIG. 2 shows a schematic cross-sectional view of a first exemplary embodiment of a dishwashing container of the dishwasher according to FIG. 1.

FIG. 2 shows a schematic cross-sectional view of a first exemplary embodiment of a dishwashing container 2 of the dishwasher 1 according to FIG. 1. Items to be washed (not shown) can be arranged in the holders 12, 13 for items to be washed in the dishwashing container 2. In the exemplary embodiment in FIG. 2 the dishwashing container 2 has a lower holder 12 for items to be washed and an upper holder 13 for items to be washed. The two holders 12 and 13 for items to be washed are configured as racks for example. The lower holder 12 for items to be washed is assigned a lower spray facility 16 for spraying the items to be washed arranged in the lower holder 12 for items to be washed with washing liquor. The lower spray facility 16 is configured as a spray arm for example. The upper holder 13 for items to be washed is assigned an upper spray facility 17 for spraying the items to be washed arranged in the upper holder 13 for items to be washed with the washing liquor. The upper spray facility 17 can be configured as a spray arm.

A hydraulic facility 18, 19 is also provided to convey the washing liquor to the lower spray facility 16 and to the upper spray facility 17. In the exemplary embodiment in FIG. 2 the hydraulic facility 18, 19 comprises a circulating pump 18 and a water diverter 19, which is coupled between the circulating pump 18 and the lower spray facility 16 or the upper spray facility 17. A sump 23 is arranged below the dishwashing container 2, the washing liquor being collected therein ahead of the circulating pump 18 and a drain pump 20.

The control device 15 shown in relation to FIG. 1 is designed to perform a dishwashing program from a number of dishwashing programs for washing the items to be washed arranged in the dishwashing container 2.

The control device 15 here is designed to actuate the hydraulic facility 18, 19 in such a manner that in a first segment of the dishwashing program the washing liquor having a first washing liquor temperature is only sprayed onto the lower holder 12 for items to be washed and in a second segment of the dishwashing program following the first segment the washing liquor having a second washing liquor temperature that is lower than the first washing liquor temperature is sprayed onto the lower holder 12 for items to be washed and the upper holder 13 for items to be washed.

In other words in the first segment of the dishwashing program the washing liquor is sprayed in particular only onto the items to be washed that are held in the lower holder 12 for items to be washed. Therefore in this first segment of the dishwashing program items to be washed that are arranged in the upper holder 13 for items to be washed are not sprayed with the washing liquor with the higher first washing liquor temperature.

In particular in the first segment of the dishwashing program the washing liquor has the first washing liquor temperature and is provided as a first quantity of washing liquor in the dishwashing container 2. In the second segment of the dishwashing program the washing liquor has the second washing liquor temperature and is provided with a second quantity of washing liquor in the dishwashing container 2. The first washing liquor temperature is higher than the second washing liquor temperature and the first quantity of washing liquor is smaller than the second quantity of washing liquor. Such washing liquor temperature and quantity settings ensure that in the first segment the hotter washing liquor is not sprayed onto the items to be washed in the upper holder for items to be washed, while in the second segment of the dishwashing program the cooler washing liquor is sprayed onto the items to be washed in the lower holder 12 for items to be washed and in the upper holder 13 for items to be washed to clean all the items to be washed in the dishwashing chamber 4.

In the first segment of the dishwashing program the control device 15 is designed in particular to set a speed of the circulating pump 18 and/or a position of the water diverter 19 such that only the lower spray facility 16 is supplied with the washing liquor. In this first segment of the dishwashing program therefore the upper spray facility 16 is not supplied with washing liquor.

As set out above, the spray facilities 16, 17 can be configured as spray arms. The lower spray arm 16 is then arranged below the lower holder 12 for items to be washed, as shown in FIG. 2. The lower spray arm 16 preferably has outlet openings pointing upward in the direction of the lower holder 12 for items to be washed for spraying jets of washing liquor. The control device 15 here is preferably designed to set a speed of the circulating pump 18 in the first segment of the dishwashing program such that only the lower spray arm 16 is supplied with washing liquor and the jets sprayed out of the outlet openings of the lower spray arm 16 only come into contact with the items to be washed that are held in the lower holder 12 for items to be washed. This ensures that the washing liquor with the higher first washing liquor temperature does not come into contact with the items to be washed that are held in the upper holder 13 for items to be washed in the first segment of the dishwashing program.

Figure 3:
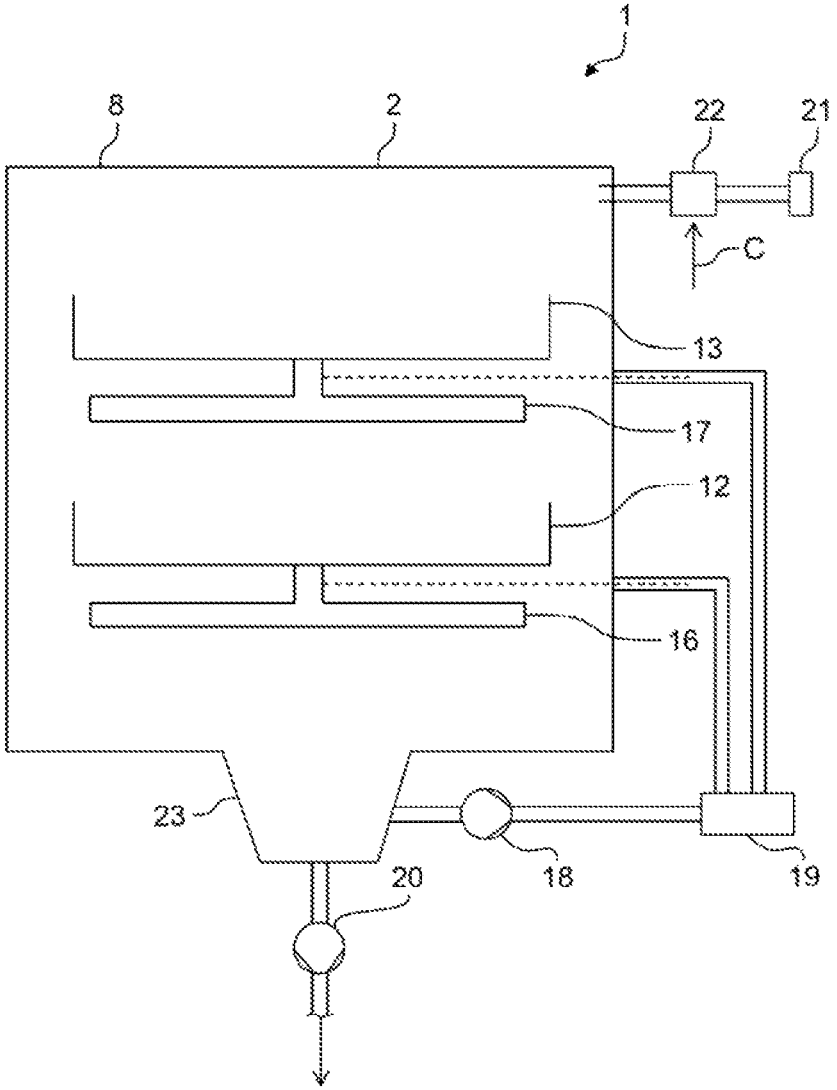
FIG. 3 shows a schematic cross-sectional view of an exemplary embodiment of a second dishwashing container of the dishwasher according to FIG. 1.

FIG. 3 shows a schematic cross-sectional view of a second exemplary embodiment of a dishwashing container 2 of the dishwasher 1 according to FIG. 1. The second exemplary embodiment of the dishwashing container 2 in FIG. 3 comprises all the features of the first exemplary embodiment according to FIG. 2. FIG. 3 also shows that a fresh water connection 21 and a valve 22 are provided. The fresh water connection 21 is designed to conduct fresh water into the dishwashing container 2. The valve 22 is connected between the fresh water connection 21 and the dishwashing container 2.

The control device 15 here is preferably designed to actuate the valve 22 by means of a control signal C after the first segment of the dishwashing program to increase the quantity of washing liquor in the dishwashing container 2 from the first quantity of washing liquor to the second quantity of washing liquor and to reduce the washing liquor temperature in the dishwashing container 2 from the first washing liquor temperature to the second washing liquor temperature. In other words the fresh water connection 21, the valve 22 and their control by the control device 15 ensure that in the first segment of the dishwashing program the washing liquor has the higher first washing liquor temperature and the smaller first quantity of washing liquor, while in the second segment and therefore after the end of the first segment the washing liquor in the dishwashing container 2 has the lower second washing liquor temperature but the larger second quantity of washing liquor.

Figure 4:
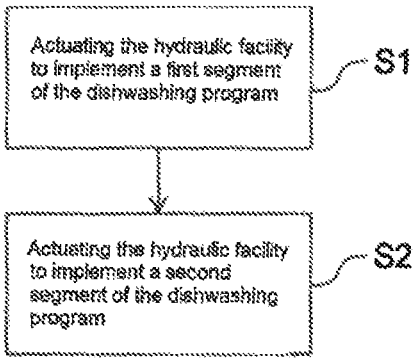
FIG. 4 shows a flow diagram of an exemplary embodiment of a method for operating a dishwasher.

FIG. 4 shows a flow diagram of an exemplary embodiment of a method for operating a dishwasher 1, as shown by way of example with reference to FIGS. 1, 2 and 3. The dishwasher 1 comprises a dishwashing container 2, a lower holder 12 for items to be washed arranged in the dishwashing container 2, an upper holder 13 for items to be washed arranged above the lower holder 12 for items to be washed, a lower spray facility 16 assigned to the lower holder 12 for items to be washed for spraying the items to be washed arranged in the lower holder 12 for items to be washed with washing liquor, an upper spray facility 17 assigned to the upper holder 13 for items to be washed for spraying the items to be washed arranged in the upper holder 13 for items to be washed with washing liquor, a hydraulic facility 18, 19, for example comprising a circulating pump 18 and a water diverter 19, for conveying the washing liquor to the lower spray facility 16 and to the upper spray facility 17, and a control device 15 for performing a dishwashing program from a number of dishwashing programs for washing the items to be washed.

The exemplary embodiment of the method according to FIG. 4 comprises the steps S1 and S2:

In step S1 the hydraulic facility 18, 19 is actuated by way of the control device 15 in such a manner that in a first segment of the dishwashing program it only sprays the washing liquor having a first washing liquor temperature onto the lower holder 12 for items to be washed.

In step S2 in a second segment of the dishwashing program following the first segment the washing liquor having a second washing liquor temperature that is lower than the first washing liquor temperature is sprayed onto the lower holder 12 for items to be washed and onto the upper holder 13 for items to be washed.

Although the present invention has been described based on exemplary embodiments, it can be modified in many different ways.

The invention claimed is:

1. A dishwasher, comprising:

a dishwashing container;

a lower holder for items to be washed arranged in the dishwashing container;

an upper holder for items to be washed arranged above the lower holder;

a lower spray facility for spraying the items to be washed arranged in the lower holder with washing liquor;

an upper spray facility for spraying the items to be washed arranged in the upper holder with the washing liquor;

a hydraulic facility conveying the washing liquor to the lower spray facility and to the upper spray facility, the hydraulic facility comprising a pump and a water diverter;

a fresh water connection for conducting fresh water into the dishwashing container;

a valve arranged between the fresh water connection and the dishwashing container; and a control device executing a dishwashing program from a number of dishwashing programs for washing the items to be washed, said control device configured to actuate the valve after a first segment of the dishwashing program to conduct fresh water into the dishwashing container to increase a quantity of washing liquor in the dishwashing container from a first quantity to a second quantity and thereby reduce a washing liquor temperature in the dishwashing container from a first, higher washing liquor temperature to a second, lower washing liquor temperature, said control device configured to actuate at least one of the pump or the water diverter in such a manner that in the first segment of the dishwashing program washing liquor having the first, higher washing liquor temperature and provided as the first quantity of washing liquor in the dishwashing container is only sprayed onto the lower holder and in a second segment of the dishwashing program following the first segment washing liquor having the second, lower washing liquor temperature that is lower than the first, higher washing liquor temperature and provided as the second quantity of washing liquor in the dishwashing container is sprayed onto both the lower holder and the upper holder, to thereby clean all the items to be washed in the dishwashing container, wherein the dishwashing program comprises one of: 1) a cleaning dishwashing program in which a cleaning agent is added to the washing liquor, with the first segment corresponding to a first step of the cleaning dishwashing program, or 2) a pre-rinse, with the first segment corresponding to a first step of the pre-rinse, wherein during one of the first step of the cleaning dishwashing program or the first step of the pre-rinse, the first, higher washing liquor temperature is at least 65° C., and wherein the second segment of the dishwashing program occurs after an end of the first segment during one of the cleaning dishwashing program or the pre-rinse.

2. The dishwasher of claim 1, constructed in the form of a household dishwasher.

3. The dishwasher of claim 1, wherein the pump is configured as a circulating pump for supplying the lower spray facility and the upper spray facility with the washing liquor.

4. The dishwasher of claim 3, wherein the control device is configured to set at least one parameter selected from a speed of the circulating pump or a position of the water diverter in the first segment of the dishwashing program such that only the lower spray facility is supplied with the washing liquor.

5. The dishwasher of claim 1, wherein the upper spray facility includes an upper spray arm and the lower spray facility includes a lower spray arm.

6. The dishwasher of claim 5, wherein the lower spray arm is arranged below the lower holder and has outlet openings pointing upward in a direction of the lower holder for spraying jets of washing liquor.

7. The dishwasher of claim 6, wherein the control device is configured to set a speed of the circulating pump in the first segment of the dishwashing program such that only the lower spray arm is supplied with washing liquor and the jets sprayed out of the outlet openings of the lower spray arm only contact items to be washed that are held in the lower holder.

8. A method for operating a dishwasher having a number of dishwashing programs, comprising:

actuating a hydraulic facility of the dishwasher to spray in a first segment of a selected one of the dishwashing programs washing liquor having a first, higher washing liquor temperature and provided as a first quantity of washing liquor in a dishwashing container only onto a lower holder for items to be washed arranged in the dishwasher container;

following the first segment, actuating a valve to conduct fresh water into the dishwashing container to increase a quantity of washing liquor in the dishwashing container from the first quantity to a second quantity and thereby reduce a washing liquor temperature in the dishwashing container from the first, higher washing liquor temperature to a second, lower washing liquor temperature, and actuating the hydraulic facility in a second segment of the dishwashing program following the first segment such that washing liquor having the second, lower washing liquor temperature that is lower than the first, higher washing liquor temperature and provided as the second quantity of washing liquor in the dishwashing container is sprayed onto both the lower holder and the upper holder, to thereby clean all the items to be washed in the dishwashing container, wherein the dishwashing program comprises one of: 1) a cleaning dishwashing program in which a cleaning agent is added to the washing liquor, with the first segment corresponding to a first step of the cleaning dishwashing program, or 2) a pre-rinse, with the first segment corresponding to a first step of the pre-rinse, wherein during one of the first step of the cleaning dishwashing program or the first step of the pre-rinse, the first, higher washing liquor temperature is at least 65° C., and wherein the second segment of the dishwashing program occurs after an end of the first segment during one of the cleaning dishwashing program or the pre-rinse.

9. A computer program product for operating a dishwasher having a number of dishwashing programs, comprising a computer program embodied in a non-transitory computer readable medium, wherein the computer program, when loaded into a program-controlled facility and executed by the program-controlled facility, causes the program-controlled facility to perform the steps of:

actuating a hydraulic facility of the dishwasher to spray in a first segment of a selected one of the dishwashing programs washing liquor having a first, higher washing liquor temperature and provided as a first quantity of washing liquor in a dishwashing container only onto a lower holder for items to be washed arranged in the dishwasher container;

following the first segment, actuating a valve to conduct fresh water into the dishwashing container to increase a quantity of washing liquor in the dishwashing container from the first quantity to a second quantity and thereby reduce a washing liquor temperature in the dishwashing container from the first, higher washing liquor temperature to a second, lower washing liquor temperature, and actuating the hydraulic facility in a second segment of the dishwashing program following the first segment such that washing liquor having the second, lower washing liquor temperature that is lower than the first, higher washing liquor temperature and provided as the second quantity of washing liquor in the dishwashing container is sprayed onto both the lower holder and the upper holder, to thereby clean all the items to be washed in the dishwashing container, wherein the dishwashing program comprises one of: 1) a cleaning dishwashing program in which a cleaning agent is added to the washing liquor, with the first segment corresponding to a first step of the cleaning dishwashing program, or 2) a pre-rinse, with the first segment corresponding to a first step of the pre-rinse, wherein during one of the first step of the cleaning dishwashing program or the first step of the pre-rinse, the first, higher washing liquor temperature is at least 65° C., and wherein the second segment of the dishwashing program occurs after an end of the first segment during one of the cleaning dishwashing program or the pre-rinse.

* * * * *